US009918502B2

(12) United States Patent
Oliver et al.

(10) Patent No.: US 9,918,502 B2
(45) Date of Patent: Mar. 20, 2018

(54) CONDITIONING GARMENTS

(71) Applicant: SURVITEC GROUP LIMITED, Birkenhead, Merseyside (GB)

(72) Inventors: Alan Paul Oliver, Rhyl (GB); Brendan Patrick Smith, Liverpool (GB)

(73) Assignee: SURVITEC GROUP LIMITED, Birkenhead, Merseyside (GB)

( * ) Notice: Subject to any disclaimer, the term of this patent is extended or adjusted under 35 U.S.C. 154(b) by 397 days.

(21) Appl. No.: 14/586,655

(22) Filed: Dec. 30, 2014

(65) Prior Publication Data

US 2015/0173431 A1 Jun. 25, 2015

Related U.S. Application Data

(63) Continuation-in-part of application No. 12/442,364, filed as application No. PCT/GB2007/003433 on Sep. 11, 2007, now abandoned.

(30) Foreign Application Priority Data

Sep. 21, 2006 (GB) ..... 0618629.0

(51) Int. Cl.
*A61F 7/00* (2006.01)
*A41D 13/005* (2006.01)

(52) U.S. Cl.
CPC ..... *A41D 13/005* (2013.01)

(58) Field of Classification Search
CPC ..... A41D 13/0051; A41D 13/0053; A41D 13/005; A61F 2007/0054; A61F 2007/0056
See application file for complete search history.

(56) References Cited

U.S. PATENT DOCUMENTS 4,026,299 A * 5/1977 Sauder ..... A61F 7/02 607/104
4,691,762 A * 9/1987 Elkins ..... A61F 7/02 165/46

(Continued)

FOREIGN PATENT DOCUMENTS

FR 2805340 8/2001
GB 850356 10/1960

(Continued)

OTHER PUBLICATIONS

U.S. Appl. No. 12/442,364, filed Mar. 20, 2009, Alan Paul Oliver.

(Continued)

*Primary Examiner* — Kaitlyn Smith
(74) *Attorney, Agent, or Firm* — Workman Nydegger

(57) ABSTRACT

A conditioning garment has an array of tubes (11) for passing heated/cooled fluid to heat/cool a wearer of the garment. The array of tubes (11) terminate at a connector (16) for connection to a source of heated/cooled liquid. The connector (16) comprises a male part (15) and a female part (17) with a releasable latch (22, 34, 40) acting between the male and female parts (15, 17) to hold the male part (15) in engagement with the female part (17). The releasable latch includes a release member (40) moveable in a rectilinear path away from the connector (16) to release the latch and allow separation of the male part (15) from the female part (17). The male and female parts (15, 17) are self-sealing on disengagement. This allows for automatic separation of the male and female parts (15, 17) in an emergency.

12 Claims, 6 Drawing Sheets

(56) References Cited

U.S. PATENT DOCUMENTS 4,982,736 A * 1/1991 Schneider ..... A61F 7/02 137/614.04
5,190,032 A * 3/1993 Zacoi ..... A61F 7/02 607/104
5,263,336 A * 11/1993 Kuramarohit ..... A41D 13/0056 165/46
5,411,542 A * 5/1995 Jensen ..... A61F 7/0097 126/207
5,456,701 A * 10/1995 Stout ..... A61F 7/02 165/46
6,178,562 B1 * 1/2001 Elkins ..... A41D 13/005 2/102
6,547,284 B2 * 4/2003 Rose ..... F16L 37/56 285/1
6,802,855 B2 * 10/2004 Ellingboe ..... A61F 7/0085 607/104
6,827,728 B2 * 12/2004 Ellingboe ..... A61F 7/02 137/594
7,765,616 B2 * 8/2010 Gammons ..... A41D 13/005 2/115
7,823,625 B2 * 11/2010 Gammons ..... F16L 37/0841 165/46
8,226,698 B2 * 7/2012 Edelman ..... A61F 7/02 607/104
8,262,716 B2 * 9/2012 Bleam ..... A61F 7/12 607/104
8,603,150 B2 * 12/2013 Kane ..... A61F 7/007 607/111
2002/0138033 A1 * 9/2002 Elkins ..... A41D 13/005 604/6.13
2004/0030373 A1 * 2/2004 Ellingboe ..... A61F 7/0085 607/104
2006/0001727 A1 * 1/2006 Haas ..... A41D 13/0051 347/194
2007/0085340 A1 * 4/2007 Gammons ..... F16L 37/0841 285/308
2008/0288033 A1 * 11/2008 Mason ..... A61F 7/02 607/96
2009/0133853 A1 * 5/2009 Gammons ..... A41D 13/005 165/104.11
2010/0030306 A1 * 2/2010 Edelman ..... A61F 7/02 607/104
2010/0137765 A1 * 6/2010 Edelman ..... A61F 7/02 602/14
2012/0172774 A1 * 7/2012 Lowe ..... A61F 7/02 602/13
2012/0172956 A1 * 7/2012 Dewaegenaere ..... A61B 18/00 607/104
2012/0185021 A1 * 7/2012 Johnson ..... F28F 3/12 607/104
2015/0075185 A1 * 3/2015 Sims ..... F28F 1/00 62/3.5

FOREIGN PATENT DOCUMENTS

| | | |
|---|---|---|
| GB | 865002 | 4/1961 |
| GB | 2129521 | 5/1984 |
| GB | 2241034 | 8/1991 |
| GB | 2302793 | 2/1997 |
| GB | 2409150 | 6/2005 |
| GB | 0618629.0 | 9/2006 |
| WO | PCT/GB2007/003433 | 9/2007 |

OTHER PUBLICATIONS

U.S. Appl. No. 12/442,364, Oct. 4, 2011, Office Action.
U.S. Appl. No. 12/442,364, Dec. 7, 2012, Final Office Action.
U.S. Appl. No. 12/442,364, Oct. 8, 2013, Office Action.
U.S. Appl. No. 12/442,364, Jul. 31, 2014, Final Office Action.

* cited by examiner

CONDITIONING GARMENTS

RELATED APPLICATION

This application is a continuation-in-part of, and hereby claims priority to, U.S. patent application Ser. No. 12/442,364, filed Mar. 20, 2009, entitled CONDITIONING GARMENT, which is a U.S. National Stage of International Application No. PCT/GB2007/003433, filed Sep. 11, 2007, entitled CONDITIONING GARMENTS, which claims priority to United Kingdom Patent Application No. 0618629.0, filed Sep. 21, 2006. All of the aforementioned applications are incorporated herein in their respective entireties by this reference.

TECHNICAL FIELD

The invention relates to a garment arrangement including a protective garment and a conditioning garment.

BACKGROUND TO THE INVENTION

A known conditioning garment comprises at least one tube for passing heated/cooled fluid to heat/cool a wearer of the garment. The at least one tube terminates in a connector for connection to a source of heated/cooled liquid and the connector comprises a male part and a female part. A releasable latch acts between the male part and female parts to hold the male part in engagement with the female part.

Such conditioning garments are often used in situations where an emergency exit is required. For example, such conditioning garments may be used in aircraft which may require emergency exit using an ejector seat or a tank where emergency exit may be required if the tank is damaged. In these cases, it has been customary to shear the connection between the conditioning garment and the source of heated/cooled liquid in order to allow rapid exit. This is, however, unsatisfactory as the shearing action releases the fluid and may leave a considerable length of tube to impede the wearer.

It would be desirable to allow a user to wear a conditioning garment within an outer protective garment in a manner that does not compromise the protection from exterior environmental conditions.

SUMMARY OF THE INVENTION

According to one aspect of the invention, there is provided a garment arrangement including:

- a protective garment,
- a conditioning garment comprising at least one tube configured to pass heated/cooled fluid to heat/cool a wearer of the conditioning garment, wherein the conditioning garment is worn inside the protective garment, and
- a connector configured to connect the at least one tube to a source of heated/cooled liquid, the connector comprising:
  - a male part and a female part configured to allow passage of the heated/cooled liquid,
  - a releasable latch acting between the male and female parts to hold the male part in engagement with the female part, and
  - a bridge piece configured to mount the connector on the protective garment, the bridge piece including a hole through which the male part extends before entering the female part,

- the releasable latch including a release member movable to release the latch and allow separation of the male part from the female part, the male and female parts being self-sealing on disengagement.

By having a release member moveable in a rectilinear path away from the female part, the release member can be made to release in emergency situations and so allow a rapid exit without damaging the system.

According to another aspect of the invention, there is provided a garment arrangement including:

- a protective garment,
- a conditioning garment comprising at least one tube configured to pass heated/cooled fluid to heat/cool a wearer of the conditioning garment, wherein the conditioning garment is worn inside the protective garment, and
- a connector configured to connect the at least one tube to a source of heated/cooled liquid, the connector comprising:
  - a male part and a female part configured to allow passage of the heated/cooled liquid,
  - a releasable latch acting between the male and female parts to hold the male part in engagement with the female part, the releasable latch including a release member movable to release the latch and allow separation of the male part from the female part, the male and female parts being self-sealing on disengagement, and
  - a bridge piece configured to sealingly mount the connector to the protective garment, the bridge piece including a hole through which the male part extends before entering the female part,
    - wherein the bridge piece allows the passage of the heated/cooled liquid,
    - wherein one of the male part and the female part is configured to be mounted inside the protective garment and the other of the male part and the female part is configured to be mounted outside the protective garment,
    - the one of the male part and the female part configured to be mounted inside the protective garment, when coupled to the bridge piece, providing a barrier to environmental conditions outside the protective garment.

According to a further example embodiment, there is provided a garment arrangement including:

- a conditioning garment comprising at least one tube configured to pass heated/cooled fluid to heat/cool a wearer of the conditioning garment, wherein the conditioning garment is configured to be optionally worn inside a protective garment, and
- a connector configured to connect the at least one tube to a source of heated/cooled liquid, the connector comprising:
  - a male part and a female part configured to allow passage of the heated/cooled liquid,
  - a releasable latch acting between the male and female parts to hold the male part in engagement with the female part, and
  - a bridge piece configured to be mountable to the protective garment, if worn, the bridge piece including a hole through which the male part extends before entering the female part,
  - the releasable latch including a release member movable to release the latch and allow separation of the male part from the female part, the male and female parts being self-sealing on disengagement.

A "loose" bridge piece may be fitted onto the male part if the conditioning garment is worn without a protective garment. Such a bridge piece may be termed a "summer land spacer" because it is fitted when the protective garment (e.g. IPG or CBRN) is not worn—for example, flying over land in peacetime when the weather is fine.

BRIEF DESCRIPTION OF THE DRAWINGS

The following is a more detailed description of an embodiment of the invention, by way of example, reference being made to the accompanying drawings in which:—

In the drawings like elements are generally designated with the same reference signs.

DETAILED DESCRIPTION OF EMBODIMENTS OF THE INVENTION

Figure 1:
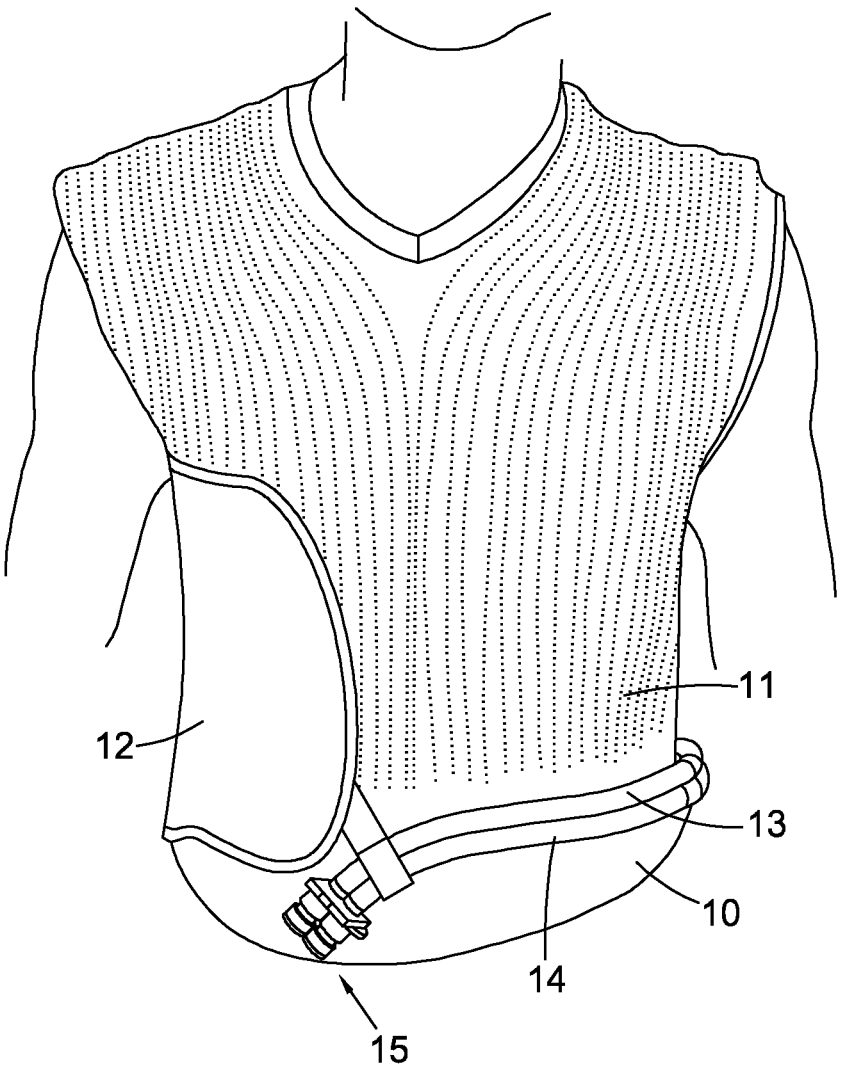
FIG. 1 is a front elevation of a conditioning garment including a male part of a connector.

Referring first to FIG. 1, the conditioning garment comprises a vest-like backing material 10 and an array of tubes 11 for passing heated/cooled fluid over the vest 10. The tubes 11 may be attached to the backing material 10, and the attachment may be performed in any suitable way—such as by adhesive, sewing, etc. The vest 10 is open at one side and, at that side, a side flap 12 is provided to allow adjustment of the size of the vest 10.

The tubes 11 extend between an inlet manifold (not shown) and an outlet manifold (not shown). The inlet manifold is connected to an inlet tube 13 and the outlet manifold is connected to an outlet tube 14. The inlet tube 13 and the outlet tube 14 are connected to a male part 15 of a connector 16. The connector 16 is shown in more detail in FIGS. 2 and 3. As seen in those Figures, the connector 16 also includes a female part 17 and a bridge piece 18.

Figure 2:
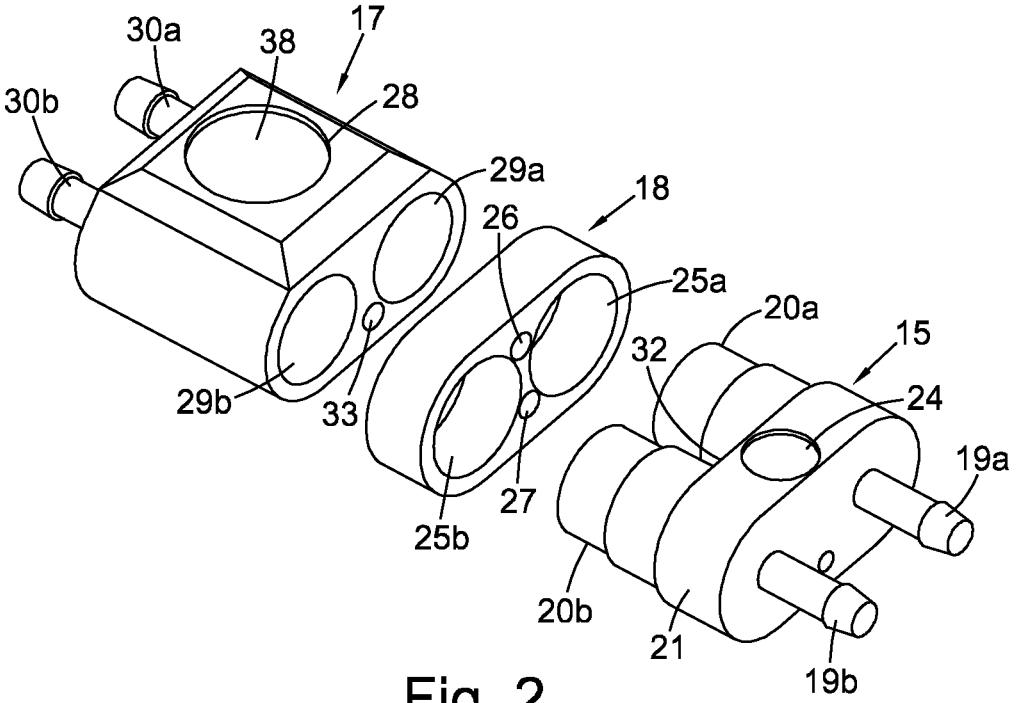
FIG. 2 is an exploded view of the connector, including the male part of FIG. 1.
Figure 3:
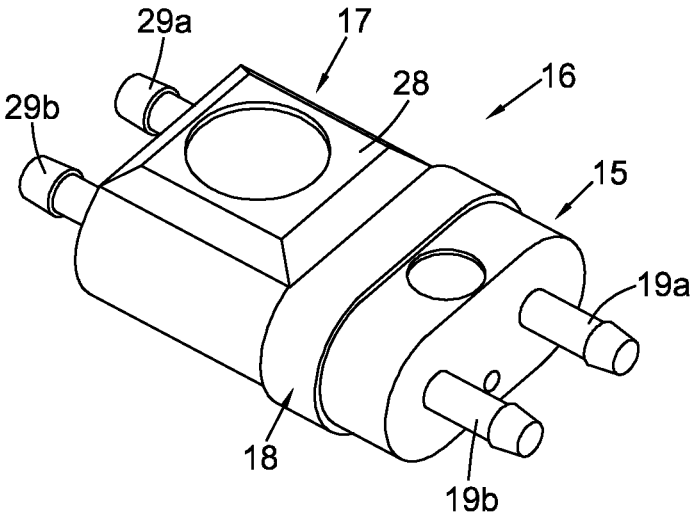
FIG. 3 is a view of the connector assembled.

Referring to FIGS. 2 and 3, the male part 15 comprises first and second parallel pipes 19*a*, 19*b* carried by a housing 21. The end of the inlet tube 13 is pushed over the first pipe 19*a* and the end of the outlet tube 14 is pushed over the second pipe 19*b*. The pipes 19*a*, 19*b* lead to respective passages 20*a*, 20*b* carried by the housing 21. As seen in FIG. 2, the passages 20*a*, 20*b* extend side-by-side but parallel from the opposite side of the housing 21 to the pipes 19*a*, 19*b*. The male part 15 also includes a first latch part 22 (FIG. 4) that projects from the housing 21 in a direction parallel to the axis of the passages 20*a*, 20*b*. The first latch part 22 is formed by a flat elongate member carrying a triangular section head 23 at its free end. The purpose of this first latch part 22 will be described below. The male part 15 further includes a locking part 122 (FIG. 4) that projects from the housing 21 in a direction parallel to the axis of the passages 20*a*, 20*b*. The locking part 122 is formed by a flat elongate member carrying a triangular section head 123 at its free end. The locking part 122 can be depressed by pushing on a button 24 provided on the housing 21. The purpose of this locking part 122 will be described below.

The bridge piece 18 comprises a mounting formed with a pair of parallel side-by-side holes 25*a*, 25*b* for receiving respective passages 20*a*, 20*b* on the male part 15. The holes 25*a* and 25*b* in the bridge piece 18 are fitted with respective "O rings" 45*a*, 45*b* (see, e.g., FIG. 6*a*) such that when the passages 20*a* and 20*b* are engaged into the holes 25*a* and 25*b* a seal is made between the passages 20*a* and 20*b* and the holes 25*a* and 25*b*. The result is that there is a seal created to prevent water or contaminants entering a protective garment 50 (see, e.g. FIG. 5). In addition, between the holes 25*a*, 25*b*, the bridge piece 18 is provided with a latching aperture 27 and a locking aperture/recess 26. The latching aperture 27 is for receiving first latch part 22 in a manner to be described below and the function of the locking aperture 26 will also be described below.

The bridge piece 18 can be connected to the garment so that, when engaged with the male part 15, the male part 15, and consequently the female part 17 when engaged with the male part 15, are located relative to the garment.

The female part 17 comprises a housing 28 formed with a pair of side-by-side passages 29*a*, 29*b*. Each passage 29*a*, 29*b* leads to a respective pipe 30*a*, 30*b* projecting from the housing 28. A supply tube (not shown) leading from a source of heated/cooled fluid, such as a pilot cooling unit, (not shown) has an end pushed over the first pipe 30*a* in order to supply heated/cooled fluid to the tubes 11 for heating/cooling the wearer. A return tube (not shown) has an end pushed over the second pipe 30*b* and returns the fluid, after it has passed through the tubes 11 and has performed its heating/cooling function, to the source of heated/cooled fluid so that, for example, the returned fluid can be heated or cooled again for passing back to the tubes 11 via the supply tube.

Figure 4:
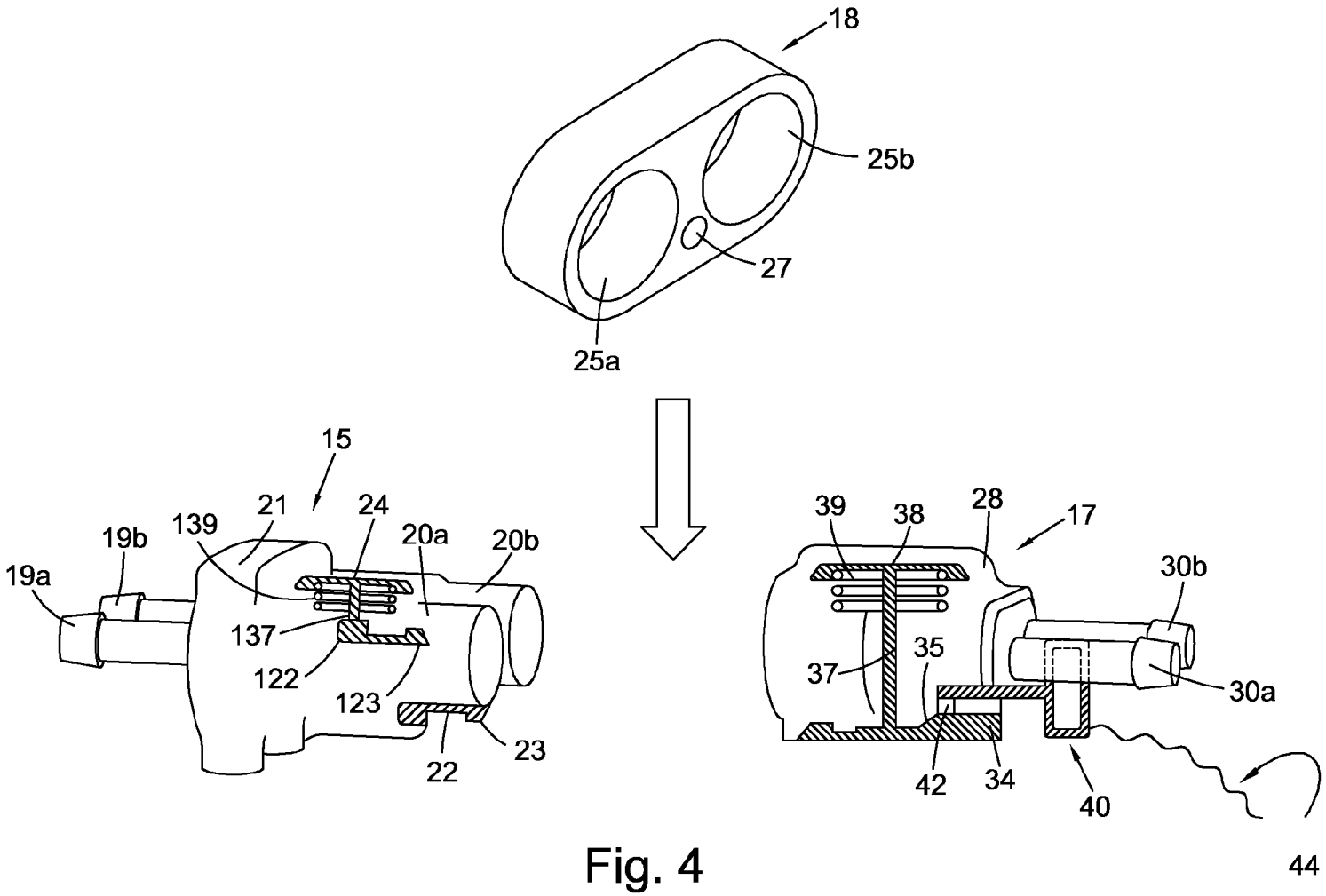
FIG. 4 is a side elevation partly in section of the connector of FIG. 3 showing a release member and a latch with the male part disengaged from the female part.

FIG. 4 shows the male and female parts 15, 17, and the bridge piece 18.

The length of the locking part 122 is sufficient to allow it to pass into the locking aperture 26 in the bridge piece 18, as the parts are fitted together as described below. The triangular section head 123 of the locking part 122 engages with a triangular section head (not shown) in the locking aperture 26 that is complimentary to the head 123 of the locking part 122.

A connecting bar 137 is fixed to the flat elongate member of the locking part 122 and extends normal thereto through the male housing 21 to connect to the push button 24. The push button 24 is urged out of the male housing 21 by a spring 139 acting between the push button 24 and the male housing 21. Depression of the push button 24 thus moves the locking part 122 against the action of the spring 139 in a direction normal to the length of the locking part 122.

The locking part 122 operates as follows. The male part 15 and the bridge piece 18 are aligned with the male passages 20*a*, 20*b* in alignment with the bridge piece holes 25*a*, 25*b*. The male passages 20*a*, 20*b* are then pushed through the bridge piece holes 25*a*, 25*b*. As this happens, the end of the locking part 122 enters the locking aperture 26 in the bridge piece 18 and the head 123 engages a triangular section head (not shown) in the locking aperture 26. This moves the locking part 122 against the action of the spring 139 to allow the head 123 on the locking part 122 to pass the triangular section head in the locking aperture 26. When the male passages 20*a*, 20*b* are fully inserted into the bridge piece holes 25*a*, 25*b*, the head 123 on the locking part 122 engages behind the triangular section head in the locking aperture 26 so preventing the male part 15 being disengaged from the bridge piece 18.

The male part 15 can be disengaged from the bridge piece 18 as follows. The push button 24 is be depressed to move the locking part 122 downwardly to disengage the triangular section head in the locking aperture 26 from the head 123 on the locking part 122. The male passages 20*a*, 20*b* can then be withdrawn from the bridge piece holes 25*a*, 25*b*.

The conditioning garment may be worn without a protective garment 50. If the conditioning garment is to be worn without a protective garment 50 then a bridge piece can be supplied "loose", that is not fitted into a protective garment. This loose bridge piece is put onto the male part 15 to replace the bridge piece that would have been fitted into the protective garment had the protective garment been worn.

The following is an explanation of how the male part 15 and the female part 17 are engaged and disengaged.

The length of the first latch part 22 is sufficient to allow it to pass through the latching aperture 27 in the bridge piece 18 and enter the aperture 33 in the female part 17, as the parts are fitted together as described below.

The female part 17 includes a second latch part 34 of the latch member. The second part 34 comprises an elongate member extending parallel to and between the passages 29*a*, 29*b* in the female housing 28. At its end opposite the pipes 30*a*, 30*b*, the second latch part 34 is located in the female housing aperture 33 and is provided with a triangular section head 35 complimentary to the head 23 on the first part 22 of the latch member.

A portion of the second latch part 34 remote from the head 35 is provided with a ramp 36 for a purpose to be described below. A connecting bar 37 is fixed to the second part 34 and extends normal to the second part 34 through the female housing 28 to connect to a push button 38. The push button 38 is urged out of the female housing 28 by a spring 39 acting between the push button 38 and the female housing 28. Depression of the push button 38 thus moves the second latch part 34 against the action of the spring 39 in a direction normal to the length of the second latch part 34. The female housing 28 also carries a release member 40. The release member 40 extends parallel to but spaced from the second latch part 34 and has an end projecting from the female housing 28 on the same side as the pipes 30*a*, 30*b* and terminating in a loop 41. The opposite end of the release member carries a follower 42 that engages the ramp 36 on the second latch part 34.

The second latch part 34 operates as follows. The male part 15 and the female part 17 are aligned with the male passages 20*a*, 20*b* in alignment with the female passages 29*a*, 29*b*. The male passages 20*a*, 20*b* are then pushed through the bridge piece holes 25*a*, 25*b* until the male passages 20*a*, 20*b* enter the female passages 29*a*, 29*b*. As this happens, the end of the first latch part 22 enters the aperture 33 in the female housing 28 and the head 23 engages the head 35 of the second latch part 34. This moves the second latch part 34 against the action of the spring 39 to allow the head 23 on the first latch part pass the head 35 on the second latch part. When the male passages 20*a*, 20*b* are fully inserted into the female passages 29*a*, 29*b*, the head 23 on the first part 22 engages behind the head 35 on the second part 34 so preventing the male part 15 being disengaged from the female part 17.

The male part 15 can be disengaged from the female part 17 in two ways. First, the push button 38 can be depressed to move the second latch part 34 downwardly, as seen in FIG. 4, to disengage the head 35 on the second latch part 34 from the head 23 on the first latch part 22. The male passages 20*a*, 20*b* can then be withdrawn from the female passages 29*a*, 29*b*. Both the male passages 20*a*, 20*b* and the female passages 29*a*, 29*b* are self-sealing in known manner.

Secondly, the release member 40 can be moved in a rectilinear direction away from the female part 17 of the connector 16. This moves the follower 42 along the ramp 36 which moves the second latch part 34 downwardly, as seen in FIG. 4, against the action of spring 39. This has the effect described above of disengaging the head 35 on the second latch part 34 from the head 23 on the first latch part 22 so allowing the male part 15 to be disengaged from the female part 17.

The conditioning garment described above with reference to the drawings is usually used in military transportation such as a tank or an aircraft. The transportation will be provided with a heating/cooling system with a supply pipe and a return pipe connected to the female part 17, as described above. The loop 41 on the release member 40 is connected to one end of a cord 44. The other end of the cord 44 can be connected to a fixed point in the transportation system with the cord 44 being shorter than the length of the supply tube and return tube.

In the event of an emergency, such as a tank being hit by enemy fire or the use of an ejector seat in an aircraft, movement of the person away from a normal working position will tension the cord 44 which in turn will move the release member and so allow disengagement of the male part 15 from the female part 17 without any action by the wearer—the movement of the wearer will simply pull the male part 15 away from the female part 17. Thus no liquid is spilled, because the passages 20*a*, 20*b*, 29*a*, 29*b* are self-sealing and the wearer is not impeded by trailing supply and return tubes.

It will be appreciated that there are a number of modifications that can be made to the conditioning garment described above. There need not be an array of tubes on the vest; there could be a single tube. The garment need not be a vest; it could be any garment. Although the connector 16 is shown with two tubes; it could have one tube or three or more tubes. The second latch need not be as described above; it could take any suitable form. The push button 38 is optional. The latch could be a pivoting latch that is rotated by operation of the release member 40.

Figure 5:
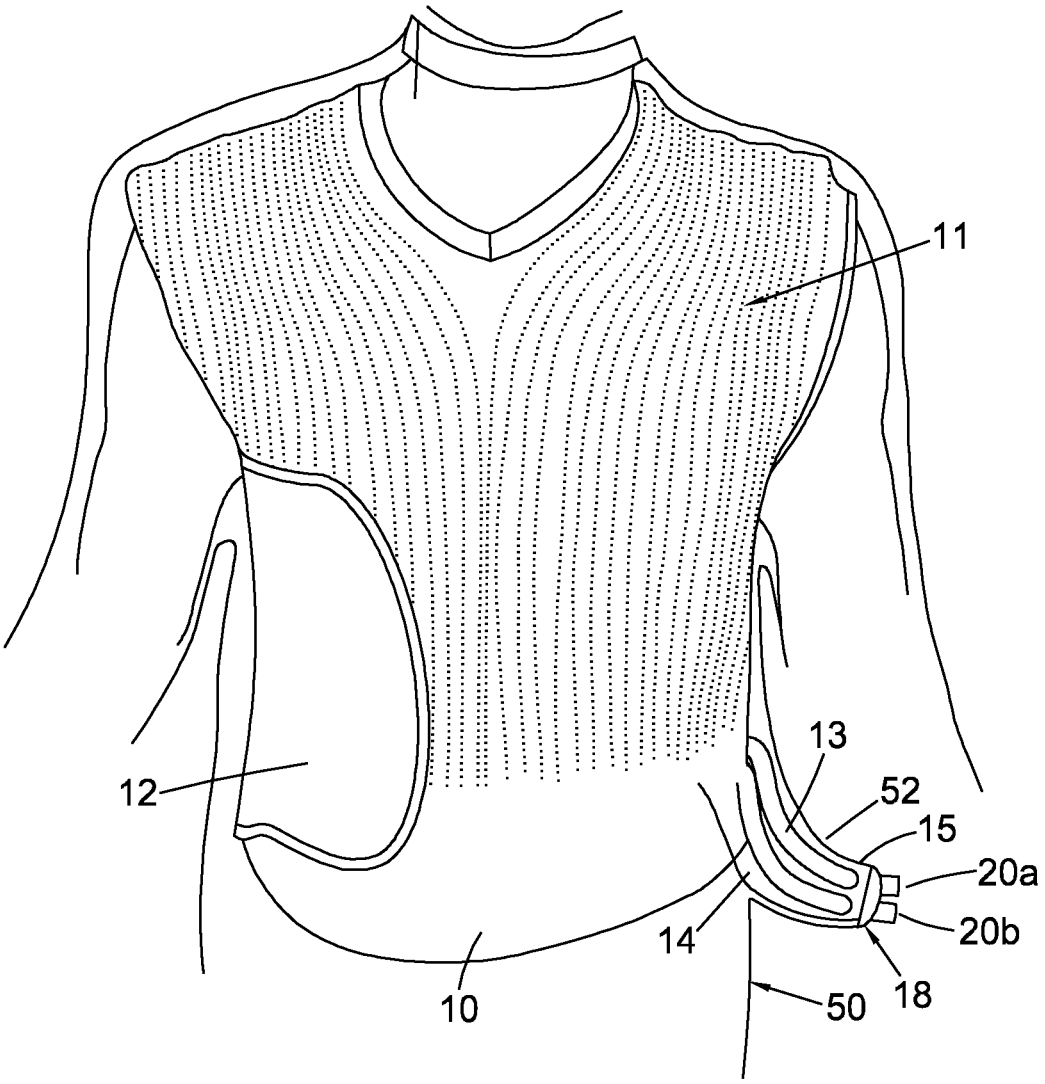
FIG. 5 is a similar view to FIG. 1 in which a protective garment is worn over the conditioning garment to protect the wearer from environmental conditions.

The conditioning garment of FIG. 1, including the vest 10, array of tubes 11 and side flap 12, is worn by a person who, for example, requires cooling or heating by the passage of fluid through the tubes 11. FIG. 5 shows a further, protective garment 50 that is worn by the person over the aforementioned conditioning garment (including the vest 10, tubes 11 and side flap 12). The protective garment 50 may be a protective suit that is sealed against the wearer's body to protect the wearer from harmful external environmental conditions. The suit may be a CBRN (chemical, biological, radiological and nuclear suit), an immersion suit or IPG (Immersion Protection Garment). The suit seals the wearer from the surrounding environment whilst still allowing operation of the conditioning garment beneath.

The protective garment 50 may include a tubular extension portion 52 (positioned at the wearer's waist in the FIG. 5 example, but may be positioned elsewhere). The tubular extension portion 52 terminates at its distal portion with an opening that has a shape and size suitable for fluid-tight coupling to the bridge piece 18 (as shown in FIGS. 2 and 3). The male part 15 (as shown in FIGS. 1 to 4) is positioned inside the tubular portion 52 and connected to the bridge piece 18 as shown in FIG. 3. The inlet tube 13 and outlet tube 14 are coupled to the first and second pipes 19A, 19B of the male part 15 in order to allow the flow of fluid to/from the tubes 11 in order to provide cooling and/or heating of the wearer of the conditioning garment.

The bridge piece 18 may also be fitted into a garment without an extension portion 52. For example, some protective garments do not have an extension piece, and the bridge piece may be bonded straight onto the protective garment—such as at a generally flat side surface.

Figure 6A:
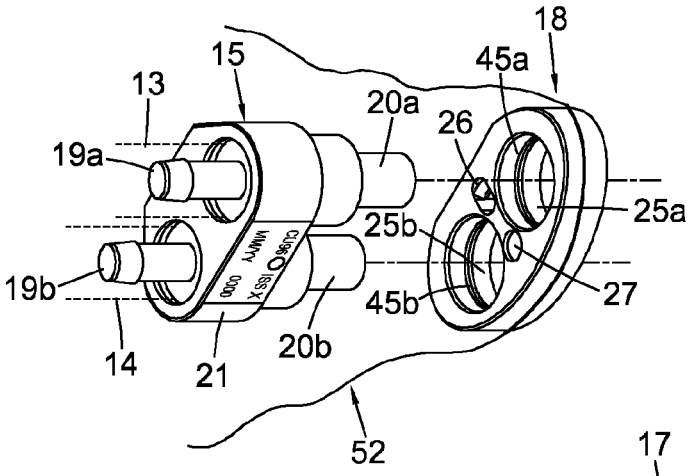
FIG. 6A is a perspective view of the male part of the connector and a bridge piece that is coupled to an opening in the protective garment.
Figure 6B:
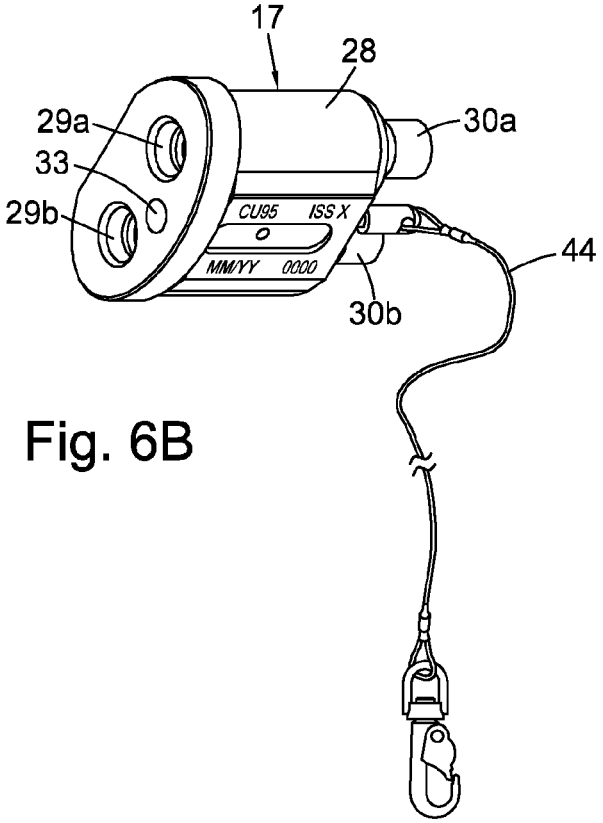
FIG. 6B is a perspective view of the female part of the connector for coupling to the male part via the bridge piece.

FIG. 6A shows the male part 15 prior to the connection to the bridge piece 18. FIG. 6B shows the female part 17 prior to connection to the male part 15 (and the bridge piece 18). In order to facilitate the connection of the male part 15 to the bridge piece 18, the protective garment 50 may be turned inside-out, including the tubular extension portion 52 (this is shown in FIG. 7C). As a result, the walls of the tubular extension portion 52 do not restrict access to the male part 15 facing surface 57 of the bridge piece 18, thereby simplifying the fixing of the male part 15 to the bridge piece 18. When the male part 15 and the bridge piece 18 are connected together, the protective garment 50, including the tubular extension portion 52, is returned to its normal configuration (as shown in FIG. 5).

In FIG. 6A and FIG. 5 the tubular portion 52 and the garment 50 are shown as transparent in order to show elements contained within. However, the garment 50 and tubular portion 52 may not be transparent in practice.

Figure 7A:
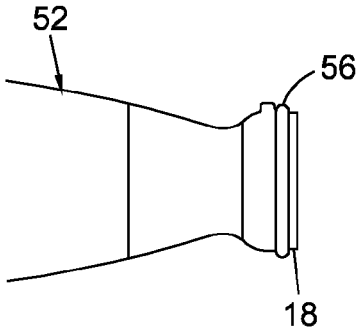
FIG. 7A is a side elevational view of a tubular portion of the protective garment coupled to the bridge piece.
Figure 7B:
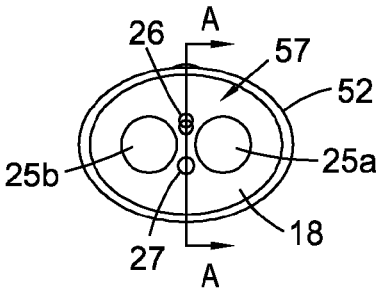
FIG. 7B is an end on view of the interior facing surface of the bridge piece to which the tubular portion of the protective garment is coupled.
Figure 7C:
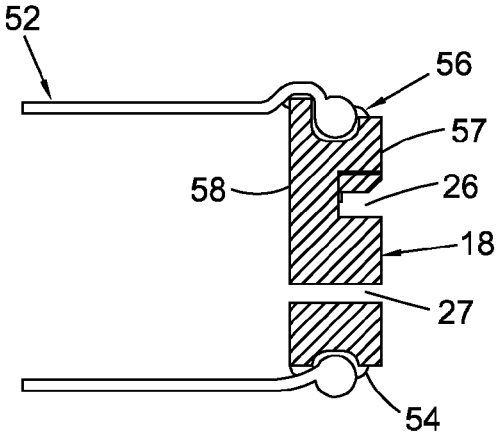
FIG. 7C is a cross-sectional view taken along the line A-A of FIG. 7B.
Figure 7D:
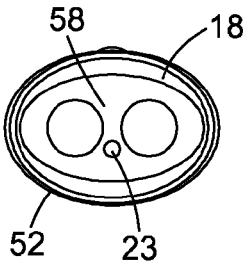
FIG. 7D is an end on view of the exterior facing surface of the bridge piece with the tubular portion of the protective garment therearound.

FIG. 7A is a side view of the tubular portion 52 attached to the bridge piece 18. FIG. 7B shows an end-on planar view of the bridge piece 18 and the circumferentially attached tubular portion 52 from the male part 15 facing side of the bridge piece 18. FIG. 7C is a cross section along the line A-A of FIG. 7B. FIG. 7D is an end-on view of the female part 17 facing side 58 of the bridge piece 18 and shows the tubular portion 52 extending therearound. In FIGS. 7C and 7D the tubular extension portion 52 is shown turned inside-out.

FIGS. 6A, 7A, 7B and 7C show in more detail the coupling of the tubular portion 52 to the bridge piece 18. The opening of the tubular portion 52 sealingly engages the outer circumference of the bridge piece 18. This may be achieved by any suitable arrangement. In the current embodiment the bridge piece 18 is provided with a circumferential recess 54 of generally concave configuration (see FIG. 7C). The distal end of the tubular portion 52 terminates in an integral bead 56 of generally circular cross section. The tubular portion 52 and the bead 56 are formed of resiliently deformable material. The distal end of the tubular portion 52 (including the bead 56) is elastically stretched over the male part 15 facing side 58 of the connecting bridge, the bead 56 then being allowed to resile such that it is accommodated within the recess 54. The shape of the bead 56 and the recess 54 and the resilience of the material of the tubular portion 52 (and bead 56) as such that a fluid-tight seal is formed between the tubular portion 52 and the bridge piece 18, thereby protecting the wearer of the garment 50 from exterior environmental conditions. The sealing between the tubular portion 52 and the bridge piece 18 may be enhanced by the use of an intermediate material, such as an adhesive of sealant provided in the recess 54.

As mentioned above, both the male passages 20*a* and 20*b* of the male part 15 and the female passages 29*a*, 29*b* of the female part 17 are self-sealing in known manner. Therefore, in the arrangement as shown in FIG. 5, prior to connection of the female part 17 to the male part 15, the integrity of the garment is maintained due to the self-sealing of the passages 20*a*, 20*b* of the male part 15. That is, the passages 20*a*, 20*b* are sealed and the distal end of the tubular portion 52 is sealed against the bridge piece 18. This prevents water or harmful environmental factors (such as chemical, biological, radiological and nuclear material) entering the garment 50 and harming the wearer.

When the female part 17 is connected to the male part 15, via the bridge piece 18, temperature controlled fluid may be provided to the conditioning garment and flows through the tubes 11 in order to heat or cool the wearer.

In the event of emergency, as described above, when the wearer of conditioning garment and protective garment 50 moves away from their normal working position, the tension in the cord 44 will pull the female part 17 away from the male part 15 (or this may be done manually by the wearer). Due to the self-sealing nature of the male passages 20*a*, 20*b* and the seal of the distal end of the tubular portion 52 against the bridge piece 18, the interior of the protective garment 50 is isolated from the external environment, thereby protecting the wearer.

The invention claimed is:

1. A garment arrangement including:

a protective garment, a conditioning garment comprising at least one tube configured to pass heated/cooled fluid to heat/cool a wearer of the conditioning garment, wherein the conditioning garment is worn inside the protective garment, and a connector configured to connect the at least one tube to a source of heated/cooled liquid, the connector comprising:

a male part and a female part configured to allow passage of the heated/cooled liquid, a releasable latch acting between the male and female parts to hold the male part in engagement with the female part, and a bridge piece configured to mount the connector on the protective garment, the bridge piece including a hole through which the male part extends before entering the female part, the releasable latch including a release member movable to release the latch and allow separation of the male part from the female part, the male and female parts being self-sealing on disengagement, wherein the male part defines a fluid passage through and co-axial with a fluid passage in the female part when the male part is engaged with the female part, the movement of the release member being in a direction parallel to the common axis of said fluid passages, wherein the releasable latch comprises a first part on the male part and a second part on the female part, the first and second parts inter-engaging when the male part is received in the female part, said movement of the release member disengaging the first and second parts to allow the male part to be removed from the female part, wherein the release member is mounted on the female part, the release member moving the second latch part to disengage the second latch part from the first latch part and allow the male part to be withdrawn from the female part, wherein the second latch part is spring loaded into engagement with the first latch part, the movement of the release member away from the female part moving the second latch part against said spring loading to disengage the second latch part from the first latch part, and wherein the second latch part is elongate and extends in a first direction parallel to said fluid passage axis and the direction of movement of said release member, the second latch part being movable in a second direction transverse to said first direction against said spring loading.

2. A garment arrangement according to claim 1 wherein the movement of said second direction is caused by a follower acting on a ramp surface as the release member is moved away from the female part.

3. A garment arrangement according to claim 2 wherein the follower is formed on the release member and the ramp on the second latch part.

4. A garment arrangement according to claim 1 wherein the first latch part is flexible so that, as the male part enters the female part, a head on the first latch part engages a head on the second latch part to flex the first latch part, the head on the first latch part pushing the head on the second latch part and engaging behind said head when the male part is fully inserted into the female part.

5. A garment arrangement according to claim 1 wherein the female part includes a push-button, depression of the button disengaging the second latch part from the first latch part.

6. A garment arrangement according to claim 5 wherein said push button is connected to the second latch part by a rod extending in said second direction, depression of the push-button moving the rod in said second direction to disengage the second latch part from the first latch part.

7. A garment arrangement according to claim 6 wherein the push-button is spring-loaded to provide said spring loading on the second latch part.

8. A garment arrangement according to claim 1 wherein the release member is connected to a cord, tension in the cord moving the release member to allow the male part to be removed from the female part.

9. A garment arrangement according to claim 1 wherein the male part includes an additional releasable latch member engaging the bridge piece to connect the male part to the bridge piece.

10. A garment arrangement according to claim 1 wherein the male part includes two side-by-side but spaced fluid passages and the female part includes two corresponding side-by-side but spaced fluid passages, each passage on the male part being received in a respective fluid passage of the female part.

11. A garment arrangement including:

a protective garment, a conditioning garment comprising at least one tube configured to pass heated/cooled fluid to heat/cool a wearer of the conditioning garment, wherein the conditioning garment is worn inside the protective garment, a connector configured to connect the at least one tube to a source of heated/cooled liquid, the connector comprising:

a male part and a female part configured to allow passage of the heated/cooled liquid, a releasable latch acting between the male and female parts to hold the male part in engagement with the female part, the releasable latch including a release member movable to release the latch and allow separation of the male part from the female part, the male and female parts being self-sealing on disengagement, and a bridge piece configured to sealingly mount the connector to the protective garment, the bridge piece including a hole through which the male part extends before entering the female part, wherein the bridge piece allows the passage of the heated/cooled liquid, wherein one of the male part and the female part is configured to be mounted inside the protective garment and the other of the male part and the female part is configured to be mounted outside the protective garment, the one of the male part and the female part configured to be mounted inside the protective garment, when coupled to the bridge piece, providing a barrier to environmental conditions outside the protective garment, and a locking part acting between the one of the male part and the female part configured to be mounted inside the protective garment and the bridge piece to hold one of the male part and the female part configured to be mounted inside the protective garment in engagement with the bridge piece, the locking part including a release member movable to release the locking part and allow separation of the one of the male part and the female part configured to be mounted inside the protective garment from the bridge piece, the one of the male part and the female part configured to be mounted inside the protective garment being self-sealing on disengagement.

12. A garment arrangement including:

a conditioning garment comprising at least one tube configured to pass heated/cooled fluid to heat/cool a wearer of the conditioning garment, wherein the conditioning garment is configured to be optionally worn inside a protective garment, and a connector configured to connect the at least one tube to a source of heated/cooled liquid, the connector comprising:

a male part and a female part configured to allow passage of the heated/cooled liquid, a releasable latch acting between the male and female parts to hold the male part in engagement with the female part, and a bridge piece configured to be mountable to the protective garment, if worn, the bridge piece including a hole through which the male part extends before entering the female part, the releasable latch including a release member movable to release the latch and allow separation of the male part from the female part, the male and female parts being self-sealing on disengagement, wherein the male part defines a fluid passage through and co-axial with a fluid passage in the female part when the male part is engaged with the female part, the movement of the release member being in a direction parallel to the common axis of said fluid passages, wherein the releasable latch comprises a first part on the male part and a second part on the female part, the first and second parts inter-engaging when the male part is received in the female part, said movement of the release member disengaging the first and second parts to allow the male part to be removed from the female part, wherein the release member is mounted on the female part, the release member moving the second latch part to disengage the second latch part from the first latch part and allow the male part to be withdrawn from the female part, wherein the female part includes a push-button, depression of the button disengaging the second latch part from the first latch part, wherein the second latch part is spring loaded into engagement with the first latch part, the movement of the release member away from the female part moving the second latch part against said spring loading to disengage the second latch part from the first latch part, wherein the second latch part is elongate and extends in a first direction parallel to said fluid passage axis and the direction of movement of said release member, the second latch part being movable in a second direction transverse to said first direction against said spring loading, and wherein said push button is connected to the second latch part by a rod extending in said second direction, depression of the push-button moving the rod in said second direction to disengage the second latch part from the first latch part, and wherein the push-button is spring-loaded to provide said spring loading on the second latch part.

* * * * *